United States Patent [19]

Schnier

[11] 3,941,642

[45] Mar. 2, 1976

[54] DRIVEN TRANSFER ROLL FOR LABELING MACHINE

[75] Inventor: Edward A. Schnier, Hubbardston, Mass.

[73] Assignee: A-T-O, Inc., Cleveland, Ohio

[22] Filed: May 9, 1974

[21] Appl. No.: 468,515

Related U.S. Application Data

[62] Division of Ser. No. 243,637, April 13, 1972, Pat. No. 3,880,115.

[52] U.S. Cl. ..... 156/297; 156/571; 156/578; 427/428

[51] Int. Cl.[2] ..... B05D 1/28

[58] Field of Search..... 117/111 R; 118/236, 243, 118/238, 244; 156/572, 571, 356, 569, 297; 427/428

[56] References Cited

UNITED STATES PATENTS

| | | | |
|---|---|---|---|
| 2,078,870 | 4/1937 | Oslund | 156/572 |
| 2,102,679 | 12/1937 | Carlson | 118/244 |
| 2,192,875 | 3/1940 | Weeden | 118/243 |
| 2,269,870 | 1/1942 | Carter | 118/236 |
| 2,460,214 | 1/1949 | Carter | 156/356 |
| 2,515,760 | 7/1950 | Dansereau | 118/243 |
| 2,528,944 | 11/1950 | Carter | 156/571 |
| 2,573,182 | 10/1951 | Carter | 156/571 |
| 2,600,205 | 6/1952 | Carter | 118/236 X |
| 2,654,497 | 10/1953 | Carter | 156/571 |
| 2,733,683 | 2/1956 | Holm | 118/243 X |
| 2,746,422 | 5/1956 | Newman et al. | 118/236 |
| 2,814,269 | 11/1957 | Stahr | 118/236 |
| 2,940,630 | 6/1960 | Carter | 156/351 |
| 2,947,433 | 8/1960 | Carter | 118/243 X |
| 3,052,210 | 9/1962 | Hughes | 118/238 |
| 3,063,408 | 11/1962 | Gustafson | 118/243 X |
| 3,202,564 | 8/1965 | Carter | 156/569 |
| 3,262,422 | 7/1966 | Carter | 118/236 X |
| 3,284,265 | 11/1966 | Carroll et al. | 156/572 X |
| 3,316,877 | 5/1967 | Harlan | 118/236 |
| 3,735,731 | 5/1973 | Tavernier | 118/236 X |

*Primary Examiner*—Ralph Husack
*Assistant Examiner*—Shriue P. Beck
*Attorney, Agent, or Firm*—Robert T. Gammons

[57] ABSTRACT

A labeling machine wherein there is a picker reciprocably movable between a label magazine and a transfer position for transferring labels to a gripper assembly at the transfer position whereupon the gripper assembly takes the label from the picker and applies it to a container and wherein there is an adhesive pick-up roll supported in a container of adhesive and a transfer roll reciprocably movable in timed relation to the movement of the picker to transfer a coating of adhesive from the pick-up roll to the surface of the picker; characterized in that the transfer roll is a driven roll and is rotated while in contact with the pick-up roll at least one complete revolution, and further characterized in that while in contact with the surface of the picker is rotated no more than one complete revolution as it travels from one end of the picker surface to the other end thereof.

2 Claims, 6 Drawing Figures

DRIVEN TRANSFER ROLL FOR LABELING MACHINE

This is a division of application Ser. No. 243,637, filed on Apr. 13, 1972 now U.S. Pat. No. 3,880,115.

BACKGROUND OF THE INVENTION

This invention pertains to labeling machines of the kind shown in U.S. Pat. Nos. 2,460,214 and 2,940,630 wherein there are pickers mounted for oscillation between a label magazine and a gripper assembly for transferring labels from the magazine to the gripper assembly which, in turn, transfers the label to a container at a label-applying station. As disclosed in the aforesaid patents each picker comprises two elongate blades arranged edge to edge with their surfaces in a common plane. Adhesive is applied to the surfaces of the picker blades by a transfer roll which, in turn, receives adhesive from a pick-up roll mounted in a container, just before the picker is moved into engagement with the label supported by the magazine, to pick the label from the magazine and following picking the picker moves to a transfer position for transferring the label to the gripper assembly. At the latter position the gripper assembly, which is provided with vacuum means, takes hold of the adhesive-coated label whereupon the picker blades are moved apart far enough to permit the gripper assembly to move forwardly between the blades toward the container to carry the label into engagement with the container. The lateral movement of the blades at the place of transfer, in conjunction with the pressure between the gripper assembly and the blades of the picker at the place of transfer, helps to spread the adhesive uniformly over the face of the label. In the aforesaid machines the pick-up roll is provided with a uniform thickness of adhesive by means of a doctor blade and this is applied to the transfer roll by holding the latter in contact with the pick-up roll until the transfer roll has made at least one complete rotation. In these machines the pick-up roll is driven but the transfer roll is not; however, the adhesive used is sufficiently tacky so that contact of the transfer roll with the pick-up roll insures rotation of the transfer roll. Hence all that is required to insure application of a fresh coating of adhesive to the entire surface of the transfer roll is to hold the transfer roll in engagement with the pick-up roll until it has made one complete revolution. There are certain types of plastic containers to which labels are applied that require the use of adhesive which is almost like water and which lacks the tackiness of the gelly-like animal glue heretofore used. When such a watery adhesive is employed it often has so little tackiness that the undriven transfer roll will not be rotated while in engagement with the pick-up roll and merely skids relative to the surface thereof even though antifriction bearings are employed. Consequently, there will be no adhesive on the surface of the transfer roll when the latter is moved along the surface of the picker for application to the picker. Additionally, because of the lack of tackiness the transfer roll may also skid along the surface of the picker, that is, as it is moved therealong so that even if there is some adhesive on the surface of the transfer roll it will not be transferred uniformly to the surface of the picker. To insure complete coating of the transfer roll with such a watery adhesive and to insure uniform transfer to the picker, the transfer roll must be driven while engaged with the pick-up roll and while in engagement with the picker.

If the length of the picker corresponds exactly to the circumferential length of the transfer roll, one complete revolution of the transfer roll will insure a fresh coating of adhesive to the entire surface of the picker. However, to avoid building machines with a picker and transfer roll having a 1:1 relation for each label size, it is customary to provide machines with pickers suitable for applying labels of all sizes and so that not only one label may be applied but several labels may be applied at the same time, for example, to the body, shoulder and neck. To do this it is necessary to make the picker of sufficient length to accommodate not only labels of all sizes but several labels at a time and so it is customary to provide the machine with pickers of sufficient length to receive all of the labels to be applied. the pickers are made in lengths of 12, 8½ and 5½ inches, — this range being such as to take care of the complete range of sizes of containers ordinarily encountered. The transfer roll for a 12 inch picker is 2 inches in diameter and so its circumference is approximately 6.2 inches long. It is obvious therefore that even if a uniform coating of adhesive is applied to the surface of the transfer roll by positively rotating it while in engagement with the pick-up roll the major portion of the adhesive will be applied to the upper portion of the picker surface, that is to the first 6.2 inches during the first complete turn thereof and that the remainder of the surface may not receive enough adhesive to provide for a proper bond. When employing conventional adhesive this condition was not too serious because some adhesive tended to stay with the surface of the transfer roll and to be spread on the remaining surface by the second rotation of the transfer roll. However, a watery adhesive does not exhibit these characteristics with the result that the portion of the picker surface beyond that corresponding to the circumferential length of the transfer roll receives substantially no adhesive. It might be thought that the doctor could be set to provide a thicker coating of adhesive on the transfer roll; however, it has been found that the transfer roll will not accumulate an excess of adhesive in a sufficient amount to provide for applying a second coating of adhesive to the picker beyond the first complete turn of the transfer roll in engagement with the picker. To achieve a uniform coating of the entire surface of the picker the transfer roll must be driven while in engagement with the picker so as to make only one complete turn while travelling from one end of the picker surface to the other.

SUMMARY

As herein illustrated, the apparatus is embodied in a label-applying machine comprising a picker having a surface to which adhesive is to be applied, said surface being of a predetermined length, and a transfer roll having a circumference of a different length for applying adhesive to the surface of the picker. The transfer roll is supported for rotation about its axis and for movement along the surface of the picker from one end to the other with the surface of the transfer roll in tangential engagement with the surface of the picker, and according to this invention to insure uniform application of adhesive to the entire surface of the picker there is means for effecting rotation of the transfer roll about its axis as it travels from one end to the other of the picker so that it makes only one complete turn. In the aforesaid arrangement the picker is oscillated between a magazine holding labels to be applied to the container and a gripper assembly to which it presents the label for application by the latter to the container. The transfer roll is oscillated in timed relation to the picker so that while the picker is moving toward the magazine it travels along the surface of the picker, applying adhesive thereto, and while the picker is moving from the magazine to the transfer position it is held in engagement with a driven pick-up roll long enough to insure that the transfer roll will make at least one complete turn in engagement with the pick-up roll.

The invention will now be described in greater detail with reference to the accompanying drawings wherein.

Figure 4:
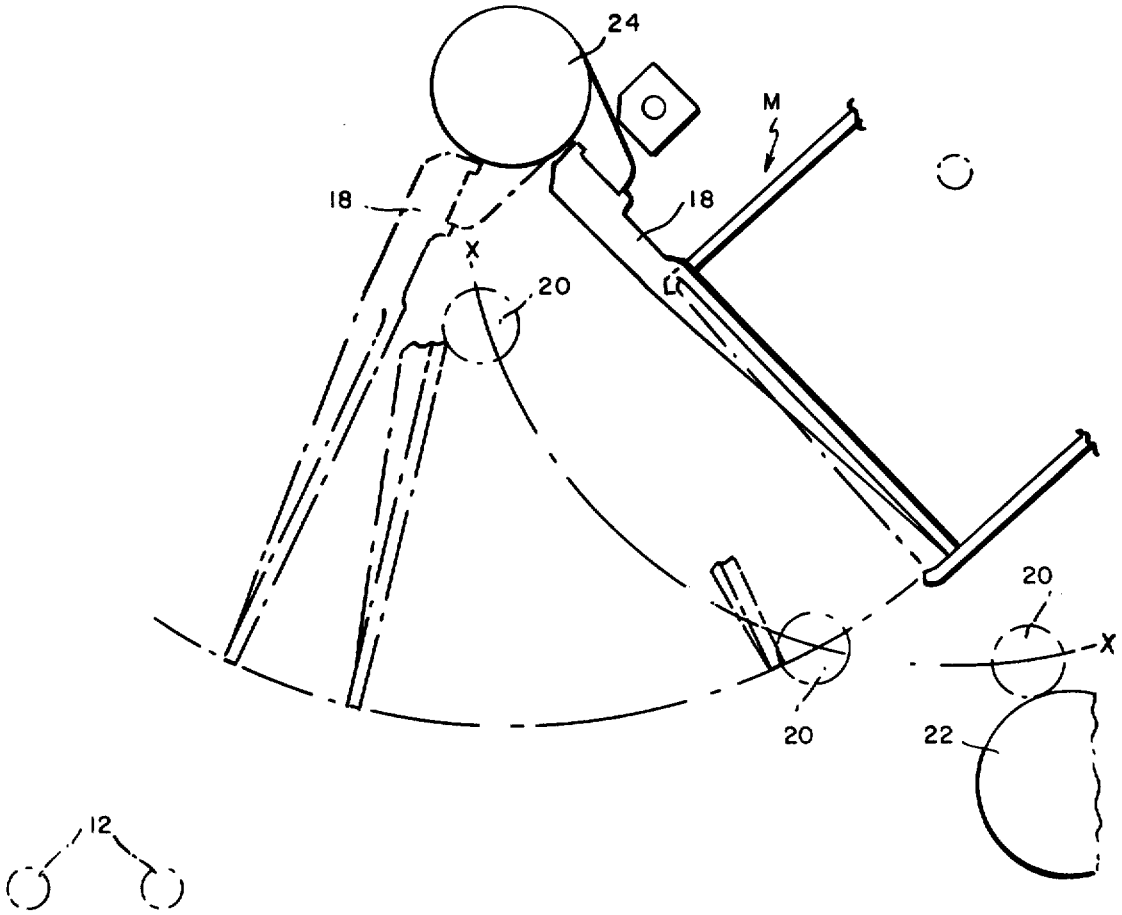
Figure 6:
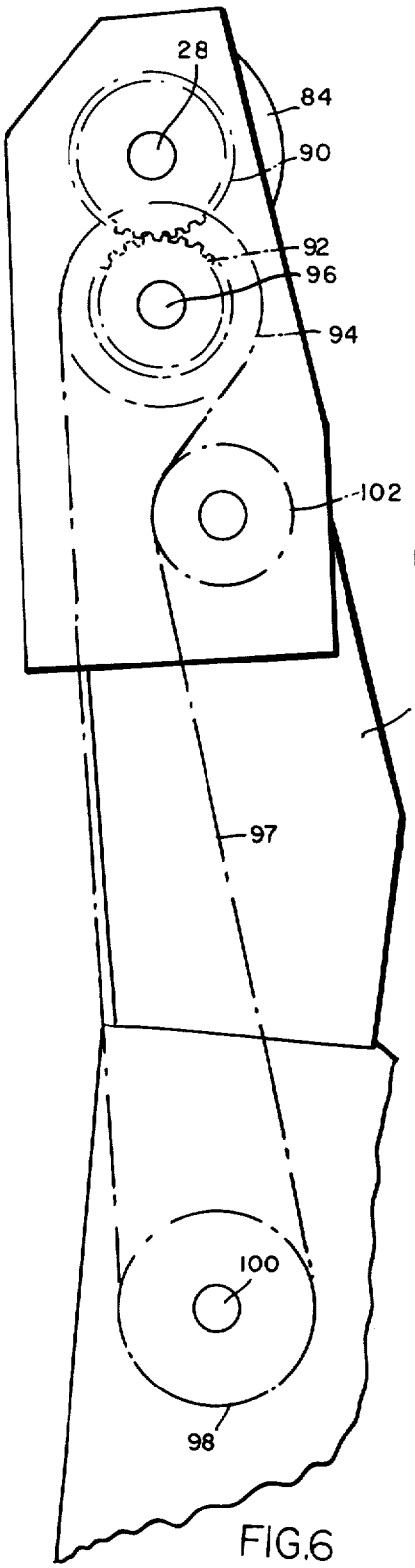
Figure 5:
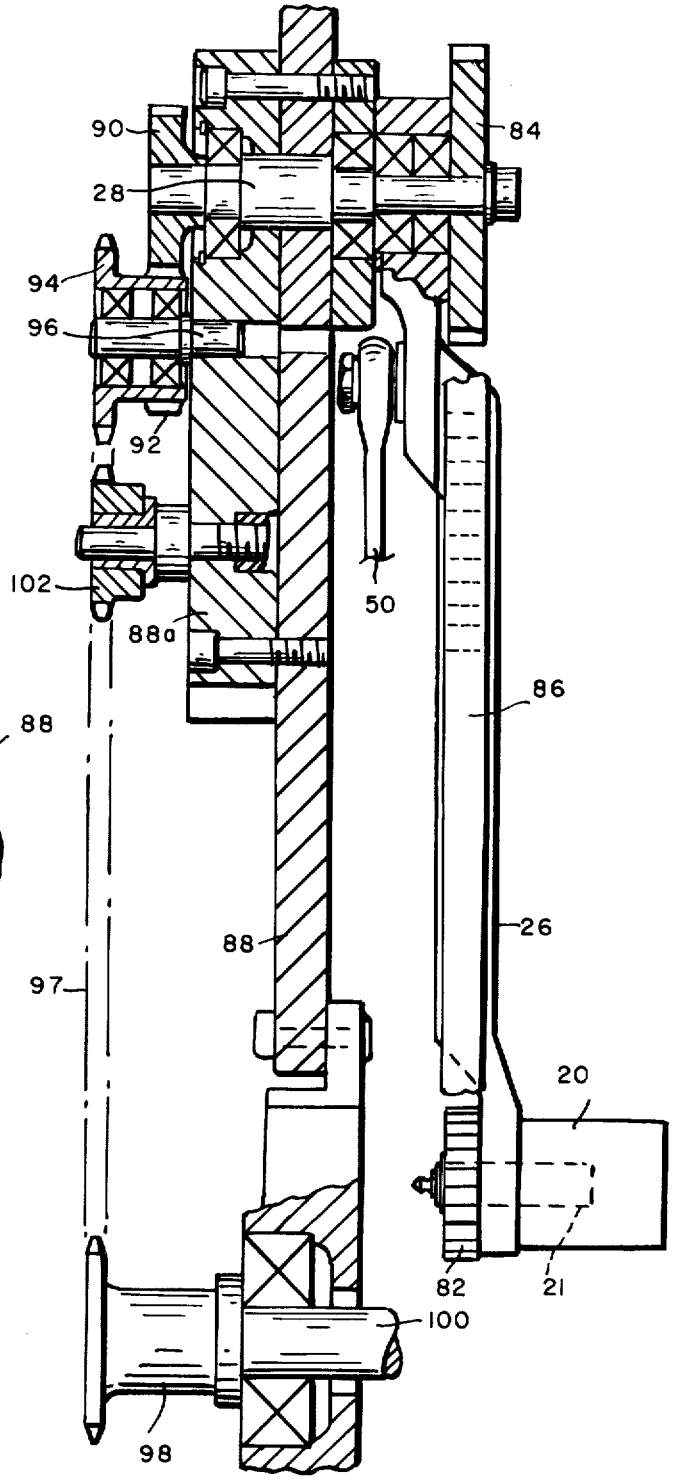

FIG. 4 diagrammatically illustrates the relative positions of a picker, label magazine and adhesive-applying transfer roll;

FIG. 5 is a fragmentary view showing the adhesive-applying transfer roll and means for effecting its arcuate and rotational movement; and FIG. 6 is a view taken from the left side of FIG. 5.

Figure 1:
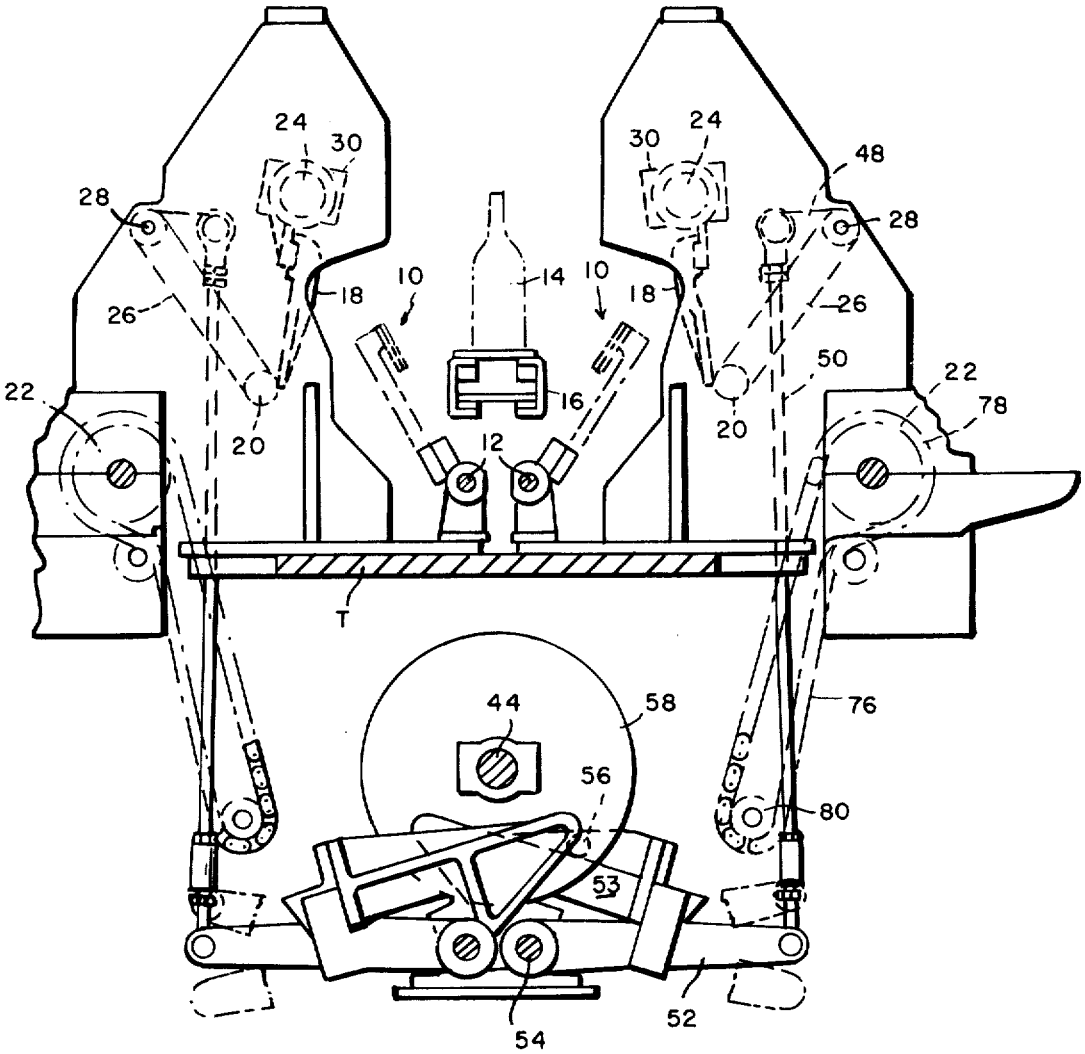
FIG. 1 is a fragmentary end elevation showing the transfer rolls applying adhesive to the pickers.
Figure 2:
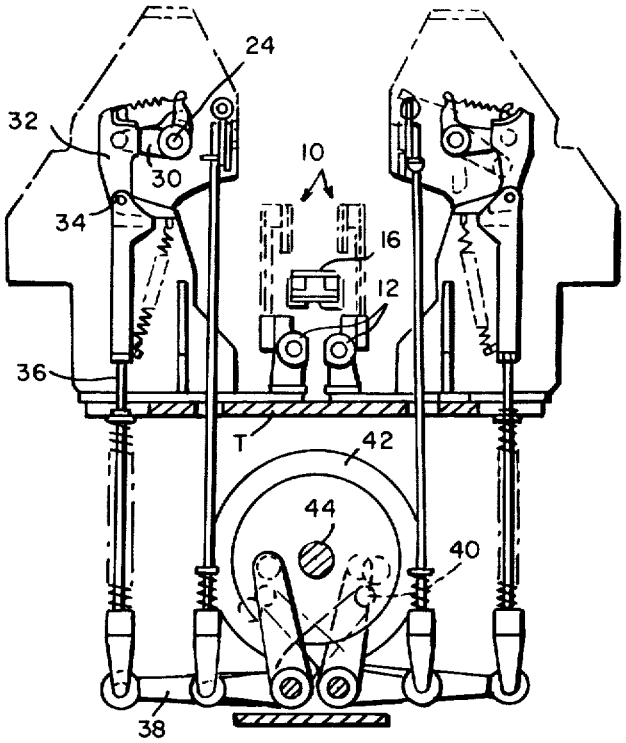
FIG. 2 is an end elevation omitting parts, showing the means for actuating the pickers.

Referring to FIGS. 1 and 2 the invention is illustrated in conjunction with a labeling machine of the kind shown in U.S. Pat. No. 2,940,630, referred to above, wherein label gripper assemblies 10 are supported in spaced parallel confronting relation to each other on spaced parallel shafts 12—12 for engagment with the opposite sides of containers 14 supported on a conveyor 16 by means of which they are moved successively to positions between the label gripper assemblies for application of labels thereto. The aforesaid machine is provided with, in conjunction with each label gripper assembly, a picker 18 which is movable to a position to take one or more labels from a magazine M (FIG. 4) of labels and move them to a position of transfer to the label gripper assembly, an adhesive transfer roll 20 for applying adhesive to the surface of the picker prior to movement of the picker into engagement with the labels and an adhesive pick-up roll 22 for supplying adhesive to the adhesive transfer roll.

The pickers are supported for swinging movement on spaced parallel shafts 24—24 and the transfer rolls are supported at the lower ends of arms 26—26, the upper ends of which are pivotally supported for swinging movement on spaced parallel shafts 28—28. Each picker shaft 24 is provided with a crank 30 (FIG. 2) which is pivotally connected to the upper end of an arm 32 of a bell-crank lever which is pivoted at 34 to the upper end of a resiliently yieldable link 36 whose lower end is pivoted to one arm 38 on a bell-crank lever, whose other arm carries a cam roller 40 which engages a cam 42 on the main shaft 44. The arm 26 to which the transfer roll 20 is attached is mounted to turn on the shaft 28 and is provided with a crank arm 48 connected by a rigid rod 50 to a crank arm 52 of a rigid rock frame 53 fixed to a rock shaft 54. Each frame has a cam follower roll 56 which engages a cam 58 mounted on the main shaft 44.

Figure 3:
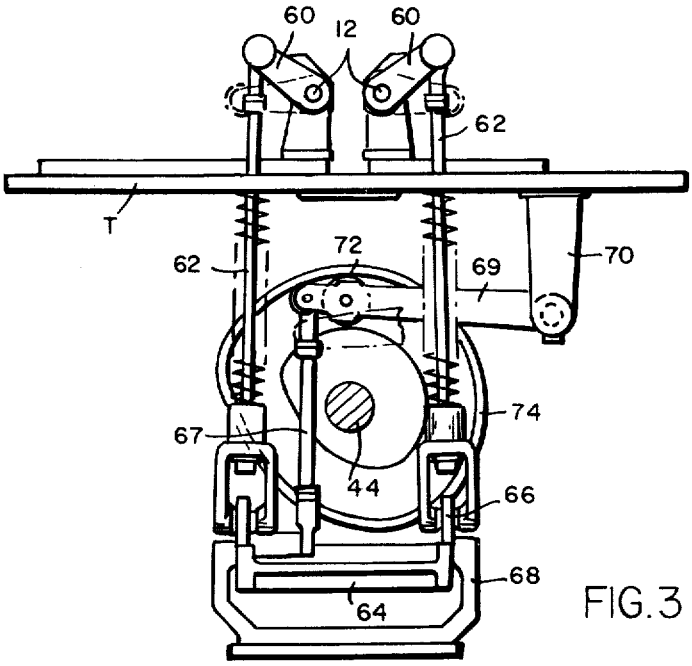
FIG. 3 is an end elevation showing the means for rocking a gripper assembly.

The shafts 12—12 on which are mounted the gripper assemblies are rocked so as to carry them in opposite directions toward the container 14 and as disclosed in the aforesaid patent these shafts are movable axially to effect movement of the assemblies back and forth longitudinally of the path of the containers. A crank 60 (FIG. 3) is fixed to each shaft 12 and is connected by a resiliently yieldable link 62 of adjustable length to a rocker 64 pivoted at 66 on a bracket 68 and this rocker 64 is connected by a link 67 to a rock arm 69 pivoted on a bracket 70 fixed to the underside of the table T. The rock arm 69 carries a cam follower roll 72 which engages a groove in a cam 74 fixed on the main shaft 44.

Each adhesive carrying roll 22 (FIG. 1) is driven by a sprocket chain 76 entrained about sprockets 78 and 80 respectively.

The foregoing structure is fully disclosed in FIGS. 14, 17 and 22 of U.S. Pat. No. 2,940,630 for which reference may be had. It suffices to say that according to the aforesaid patent the gripper assemblies 10, pickers 18 and adhesive transfer rolls 20 are moved in timed relation to each other by means of the main shaft 44 and intervening connections such that for each cycle of operation after the gripper assemblies 10 take labels from the pickers 18 the latter swing toward the line of containers sufficiently to permit the adhesive transfer rolls 20 to swing upwardly toward the pivoted ends of the pickers 18, carrying with them a coating of adhesive whereupon the adhesive transfer rolls 20 swing downwardly, moving along the surfaces of the pickers, the latter swinging outwardly as the adhesive transfer rolls travel along their surfaces and then upwardly into engagement with the labels in the magazine M whereupon they pick the labels from the magazine M and swing downwardly and toward the path of the containers to transfer positions where they give up the labels to the gripper assemblies.

In that machine and in other machines of that same kind the adhesive-applying transfer roll 20 is not driven, rotation taking place by means of its rolling engagement with the surface of the picker. If the surface of the picker to which the adhesive is to be applied is of the same length or shorter than the circumference of the adhesive applying transfer roll a uniform coating of adhesive will be applied to the entire surface of the picker. However, if the surface of the picker is longer than the circumference of the adhesive applying transfer roll that portion of the picker which exceeds in length the circumference of the adhesive applying transfer roll will have very little, if any, adhesive applied to it since most of the adhesive will be transferred during the first turn of the adhesive applying transfer roll thus the picker will have an uneven non-uniform coating of adhesive on its surface and correspondingly the labels to which this adhesive is transferred will have a non-uniform coating of adhesive applied thereto.

In accordance with this invention, the foregoing may be remedied by rotating the adhesive applying transfer roll while it is being traversed lengthwise of the picker surface so that it makes only one complete turn throughout such movement, that is, from one end to the other of the picker surface. FIG. 4 diagrammatically illustrates the relative positions of the picker 18, the label magazine M, the adhesive applying transfer roll 20 and adhesive carrying roll 22 and FIGS. 5 and 6 specifically illustrate the mounting for the adhesive applying transfer roll in elevation and section.

Referring to these figures the adhesive applying transfer roll 20 is mounted on a shaft 21 journaled in the lower end of the arm 26. The shaft 21 extends through the arm 26 and has fixed to it a gear 82 by means of which it is adapted to be rotated. A gear 84 is fixed on the shaft 28 at the upper end of the arm 26 and a gear belt 86 is entrained about these two gears 82, 84 so that rotation of the upper gear 84 effects rotation of the lower gear 82 and hence of the adhesive applying transfer roll 20. The arm 26 is adapted to swing on the shaft 28 and oscillation is effected by means of the rod 50, as heretofore described, to cause the adhesive applying transfer roll 20 to travel from the adhesive carrying roll 22 along the path depicted by the arcuate line *x—x* (FIG. 4). The shaft 28 on which the arm 26 is pivotally mounted extends through a supporting part 88 of the machine frame and has on its opposite end a gear 90. The gear 90 meshes with a second gear 92 formed on a sprocket 94 rotatably mounted on a stub shaft 96 fixed to a part 88*a*. The sprocket 94 is connected by a chain 97 entrained about it to a sprocket 98 mounted on a drive shaft 100 which in turn is connected to the main drive shaft 44. An idler sprocket 102 supported between the aforesaid sprockets 94, 98 provides for obtaining the proper degree of tension in the chain 97 for driving purposes.

The aforesaid means comprising the arms, gears and chains are so proportioned that the adhesive-applying transfer roll 20 will make one complete turn while it is travelling from one end of the picker surface to the other and since the circumferential surface of the adhesive applying transfer roll is less than the length of the picker surface, the application of adhesive to the surface of the picker is effected partly by sliding movement of the surface of the adhesive-applying transfer roll along the surface of the picker and partly by rolling engagement of the surface of the adhesive applying transfer roll on the surface of the picker and that the transfer roll will make at least one complete turn while in engagement with the pick-up roll 22.

The gears 90 and 92 comprise change gears for the purpose of changing the speed of the transfer roll 20 to allow for different lengths of pickers to maintain one revolution of the transfer roll for the different lengths of picker related above, to wit, 12, 8½ and 5½ inches.

It should be understood that the present disclosure is for the purpose of illustration only and that this invention includes all modifications and equivalents falling within the scope of the appended claims.

I claim:

1. In a method of applying labels wherein there is a picker reciprocably movable between a label magazine and a transfer position for transferring labels to a gripper assembly at the transfer position whereupon the gripper assembly takes the label from the picker and applies it to a container and wherein there is a rotating adhesive pickup roll supported in a container of adhesive and a transfer roll reciprocably movable in timed relation to the movement of the picker to transfer a uniform coating of adhesive from the pick-up roll to the surface of the picker, the improvement comprising using a picker having a surface of a predetermined length with an adhesive transfer roll having a circumferential surface of lesser length than said predetermined length and effecting rotational movement of the transfer roller against said picker at such a rate as to cause said transfer roller to make only one complete turn while traveling from one end to the other of said picker surface so as to produce a uniform coating on the entire surface of the picker.

2. In a method of applying labels wherein there is a surface of a first predetermined length to receive a uniform coating of adhesive and wherein there is a rotating adhesive pick-up roll supported in a container of adhesive and a transfer roll reciprocably movable in timed relation to the first predetermined surface to transfer a uniform coating of adhesive from the pick-up roll to the surface of the first predetermined length, the improvement comprising using a surface having a first predetermined length with an adhesive transfer roll having a circumferential surface of lesser length than said first predetermined length and effecting rotational movement of the transfer roller against said first predetermined length at such a rate as to cause said transfer roll to make only one complete turn while traveling from one end to the other of said first predetermined length so as to produce a uniform coating on the entire surface of the first predetermined length.

* * * * *